US010336565B2

(12) United States Patent
Gonzalez Perello

(10) Patent No.: US 10,336,565 B2
(45) Date of Patent: Jul. 2, 2019

(54) DRIVERS

(71) Applicants: HEWLETT-PACKARD DEVELOPMENT COMPANY, L.P., Houston, TX (US); Daniel Gonzalez Perello, Sant Cugat del Valles (ES)

(72) Inventor: Daniel Gonzalez Perello, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 359 days.

(21) Appl. No.: 15/311,711

(22) PCT Filed: May 30, 2014

(86) PCT No.: PCT/EP2014/061248

§ 371 (c)(1),
(2) Date: Nov. 16, 2016

(87) PCT Pub. No.: WO2015/180787

PCT Pub. Date: Dec. 3, 2015

(65) Prior Publication Data

US 2017/0088379 A1 Mar. 30, 2017

(51) Int. Cl.
*B65H 16/06* (2006.01)
*B65H 16/10* (2006.01)

(52) U.S. Cl.
CPC ..... *B65H 16/103* (2013.01); *B65H 16/06* (2013.01); *B65H 2301/41346* (2013.01); *B65H 2301/41369* (2013.01); *B65H 2301/413683* (2013.01); *B65H 2511/12* (2013.01);
(Continued)

(58) Field of Classification Search
CPC .. B65H 16/103; B65H 16/06; B65H 2511/12; B65H 2701/18422; B65H 2801/36; B65H 2801/12; B65H 2301/41369; B65H 2301/413683; B65H 2301/41346
See application file for complete search history.

(56) References Cited

U.S. PATENT DOCUMENTS 3,831,829 A * 8/1974 Karpisek ..... B65H 20/20 226/134
4,813,922 A * 3/1989 Kawana ..... B65H 45/1015 493/415

(Continued)

FOREIGN PATENT DOCUMENTS

CN 2606735 3/2004
CN 201471794 5/2010

(Continued)

*Primary Examiner* — William A. Rivera
(74) *Attorney, Agent, or Firm* — HP Inc. Patent Department

(57) ABSTRACT

There is disclosed a driver including an elongate shaft and at least one drive assembly. The drive assembly includes a housing which has an orifice for receiving the elongate shaft, and a drive wheel which is located at least partially within the housing. The drive wheel has a bore with a cross-section shaped so that the internal surface of the bore contacts the circumference of elongate shaft when the elongate shaft is inserted into the bore. The bore has at least two fulcrum surfaces so that the drive wheel is pivotable about the elongate shaft. The housing is slideable relative to the elongate shaft.

14 Claims, 8 Drawing Sheets

(52) U.S. Cl.
CPC ..... *B65H 2701/18422* (2013.01); *B65H 2801/12* (2013.01); *B65H 2801/36* (2013.01)

(56) References Cited

U.S. PATENT DOCUMENTS

| | | | | | |
|---|---|---|---|---|---|
| 4,887,926 | A * | 12/1989 | Kunz | B65H 18/06 | 403/27 |
| 5,816,515 | A * | 10/1998 | Kruger | B65H 59/225 | 242/150 M |
| 6,004,053 | A | 12/1999 | Petteruti et al. | | |
| 7,905,400 | B2 | 3/2011 | Stoutenburg et al. | | |
| 8,689,849 | B2 | 4/2014 | Maddaleni et al. | | |
| 2008/0006511 | A1* | 1/2008 | Jackson | B65H 27/00 | 198/624 |
| 2008/0277851 | A1* | 11/2008 | Genta | B41J 15/042 | 269/56 |
| 2009/0266926 | A1 | 10/2009 | Yoshimaru et al. | | |
| 2013/0271543 | A1 | 10/2013 | Akatsu et al. | | |
| 2014/0063150 | A1 | 3/2014 | Miyazaki et al. | | |
| 2014/0073043 | A1 | 3/2014 | Holmes et al. | | |
| 2016/0023264 | A1* | 1/2016 | Barnes | B08B 9/0433 | 226/152 |

FOREIGN PATENT DOCUMENTS

| | | |
|---|---|---|
| DE | 2548097 | 5/1977 |
| JP | S62167159 | 7/1987 |
| JP | H02286551 | 11/1990 |
| JP | 2003025667 A | 1/2003 |
| JP | 2012076835 | 4/2012 |
| WO | WO 2009119240 A1 | 10/2009 |

* cited by examiner

DRIVERS

BACKGROUND

In a device handling paper, such as a printer, it is important to be able to control the torque applied to a roll of paper. Two main systems may be used to drive media input rolls, spindle systems and spindleless systems.

DETAILED DESCRIPTION

Spindle systems include an elongate spindle on which a roll of media may be mounted. The length of the spindle is not necessarily the same as the length of the roll. A driver may be provided to provide a torque to one of the ends of the spindle, thereby to drive the spindle and thus drive the roll. The driver is often driven by a DC motor.

In order to ease installation of a roll of paper into a printer, spindleless rolls have been developed and have become widely accepted by printer manufacturers. With spindleless systems, the roll is suspended in a roll module or sled between two biased roll supports that are slideable along the roll axis. The sled additionally accommodates drive elements to drive the roll supports.

Most users find spindleless systems ease installation of a roll as no pre-assembly of the roll onto a spindle is necessary. Rolls of different lengths are also easily accommodated by the biased roll supports and the roll supports are arranged such that the roll is centred in the sled after the roll has been positioned in the housing. This is achieved by using opposing conical roll supports which further eases installation of the roll into the housing.

Improving the alignment of a driver for driving a media roll in printer can be achieved by providing additional flexibility in the alignment of the driver relative to the media roll. Thus, the driver can provide good torque control on the media roll without the necessity of careful alignment of the media roll in a printer. This provides advantages because alignment of media rolls and drivers is a problem in printers due to the frequency of changing of media throughout the life of the printer. Poor alignment of a media roll can adversely affect print quality and adversely affect the reliability of media feed. Such a capability forms the foundation of the present disclosure.

Figure 1:
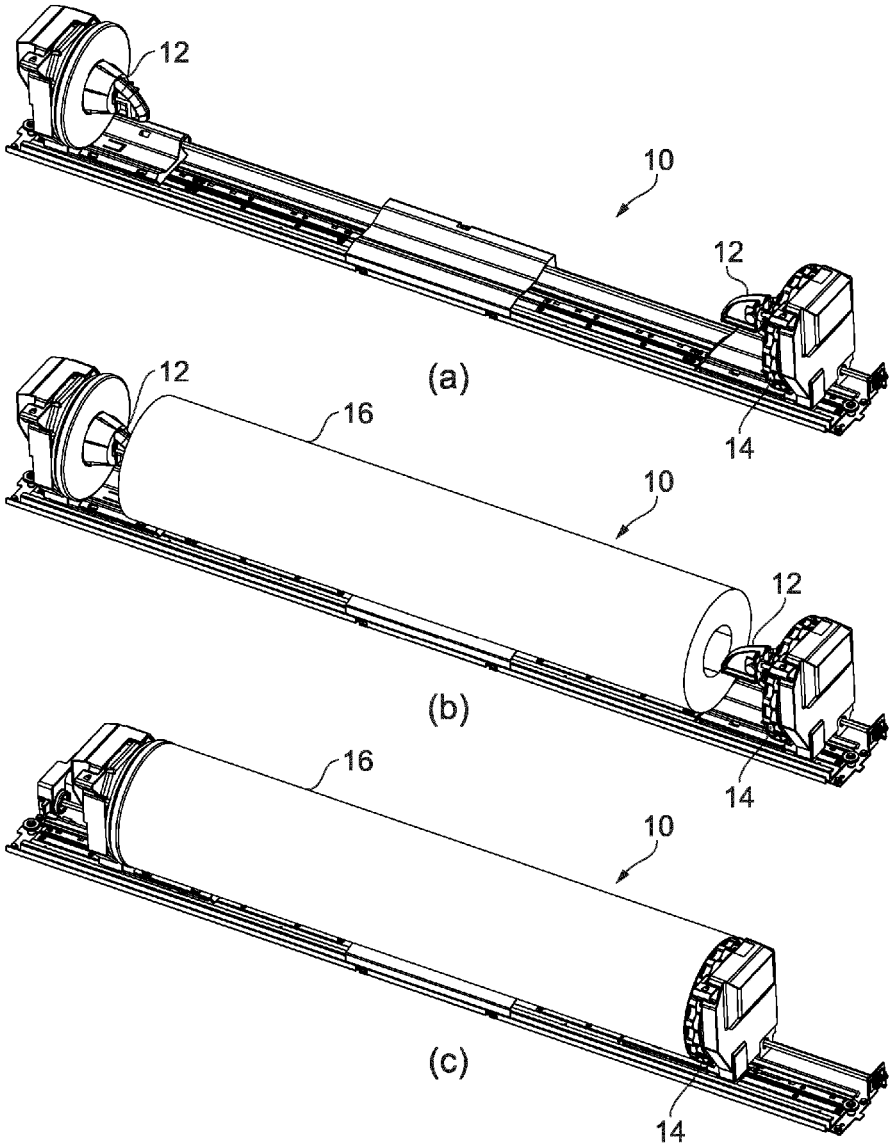
FIGS. 1 (*a*) to (*c*) are diagrams illustrating an example of a roll module and installation of a media roll therein.

Accurate transfer of torque is necessary to feed media accurately from a media roll toward a print engine in a printer so that the printer may print onto the media accurately. A roll module 10 includes two opposed biased roll supports 12 as shown in FIG. 1 (*a*). The roll supports 12 may be biased using springs such that the roll supports 12 spring toward one another. The roll supports may be biased using other means such as cables to move both roll supports simultaneously while keeping the midpoint between them constant. At least one roll support 12 is connected to a drive hub 14 and the drive hub is adapted to cooperate with a driver to drive the media roll 16. One roll support may be a passive roll support. To load the media roll 16 in the roll module 10, the roll supports 12 are first pulled apart and a media roll 16 is inserted therebetween. The roll supports 12 are then released and suspend the media roll 16 between the roll supports 12. The roll supports are conical such that insertion of the media roll 16 between the roll supports 12 automatically centres the media roll 16 in the roll module as shown in FIGS. 1 (*b*) and (*c*).

Figure 2:
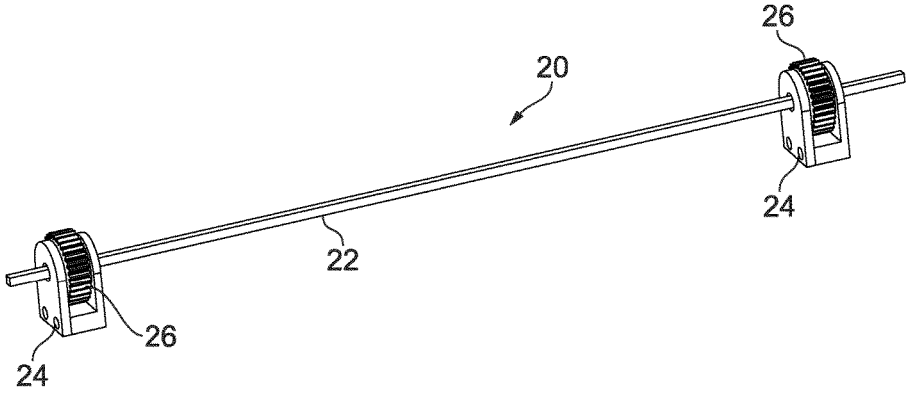
FIG. 2 illustrates an example of a drive assembly and elongate shaft.

An example of a driver 20 is illustrated in FIG. 2. The driver 20 includes an elongate shaft 22. The shaft 22 has a polygon shaped cross-section and includes at least two parallel sides. The driver 20 includes a drive assembly housing 24 which is provided with an orifice for receiving the elongate shaft.

Figure 3:
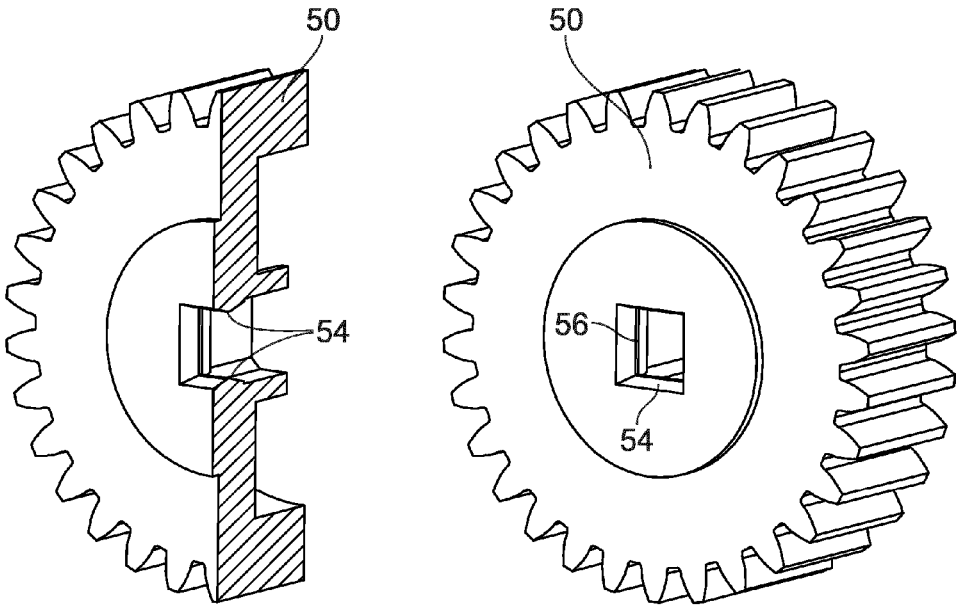
FIG. 3 illustrates an example of a drive wheel.

A drive wheel 26 located at least partially within the housing. The drive wheel 26 has a bore 27 with a cross-section shaped so that the internal surface of the bore 27 contacts the circumference of elongate shaft as shown for example, in FIG. 3.

Figure 4:
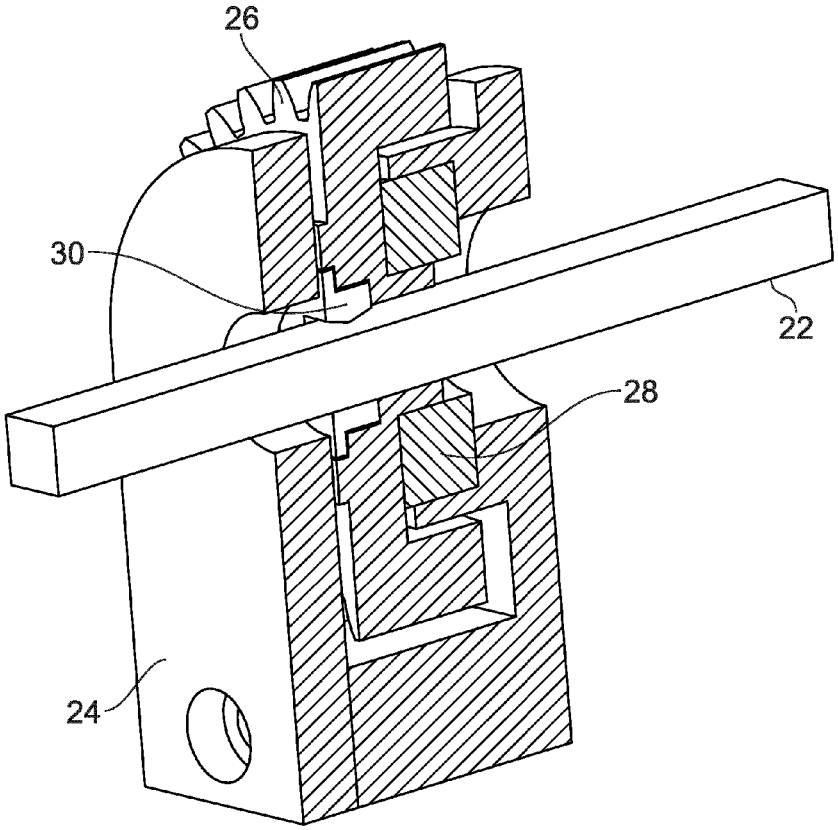
FIG. 4 illustrates an example of a drive assembly shown in cross-section.

The bore 27 has at least two fulcrum surfaces 29 as shown for example, in FIG. 4. The bore 27 and fulcrum surfaces 29 may be integral to the drive wheel.

The fulcrum surfaces 29 are shaped so that the drive wheel 26 is pivotable about the shaft 22 as shown in the example illustrated in FIG. 4 which shows a cross-sectional view of a drive assembly. The elongate shaft is inserted through the drive assembly housing 24 and through the bore of the drive wheel 26. Bearings 28 may be used to hold the drive wheel 26 at least partially within the drive assembly housing 24.

The drive assembly is slideable relative to the shaft 22. In this manner, the driver may accommodate roll modules of different lengths, and similarly, the driver may drive drive hubs having different separations.

Figure 5:
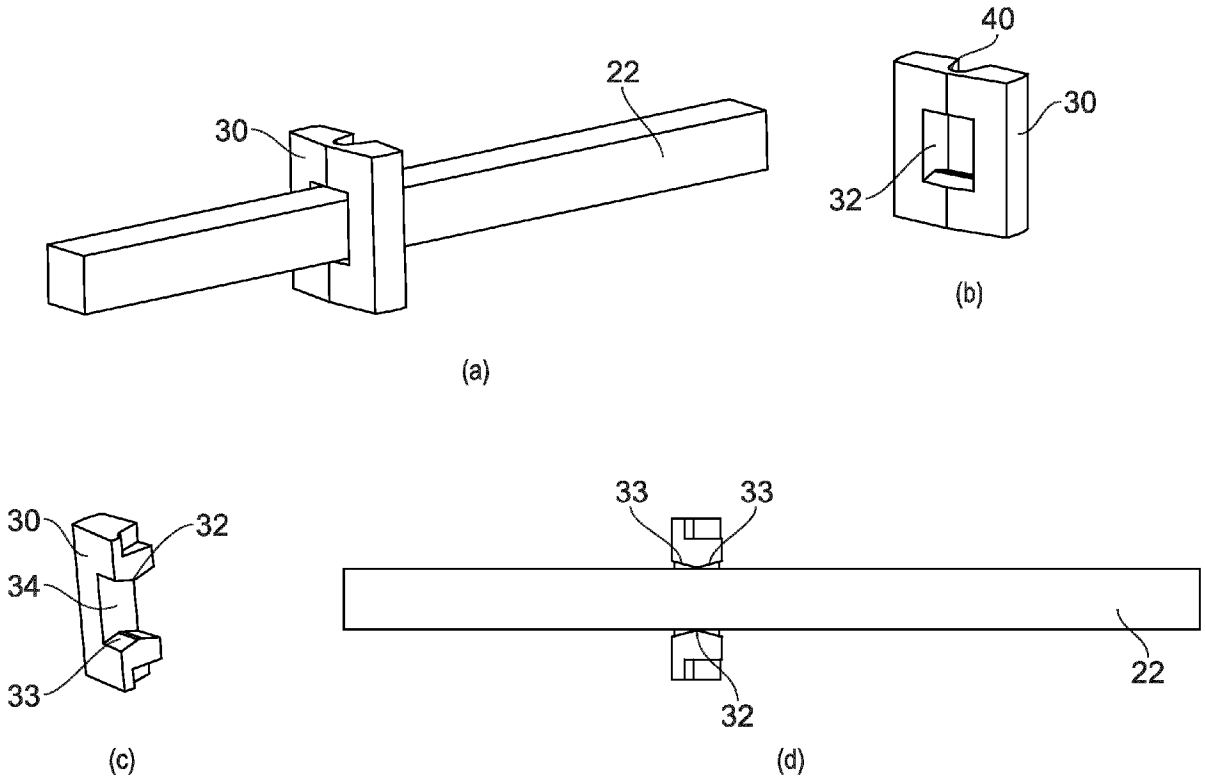
FIGS. 5 (*a*) to (*d*) illustrate an example of a rocking plate.
Figure 6:
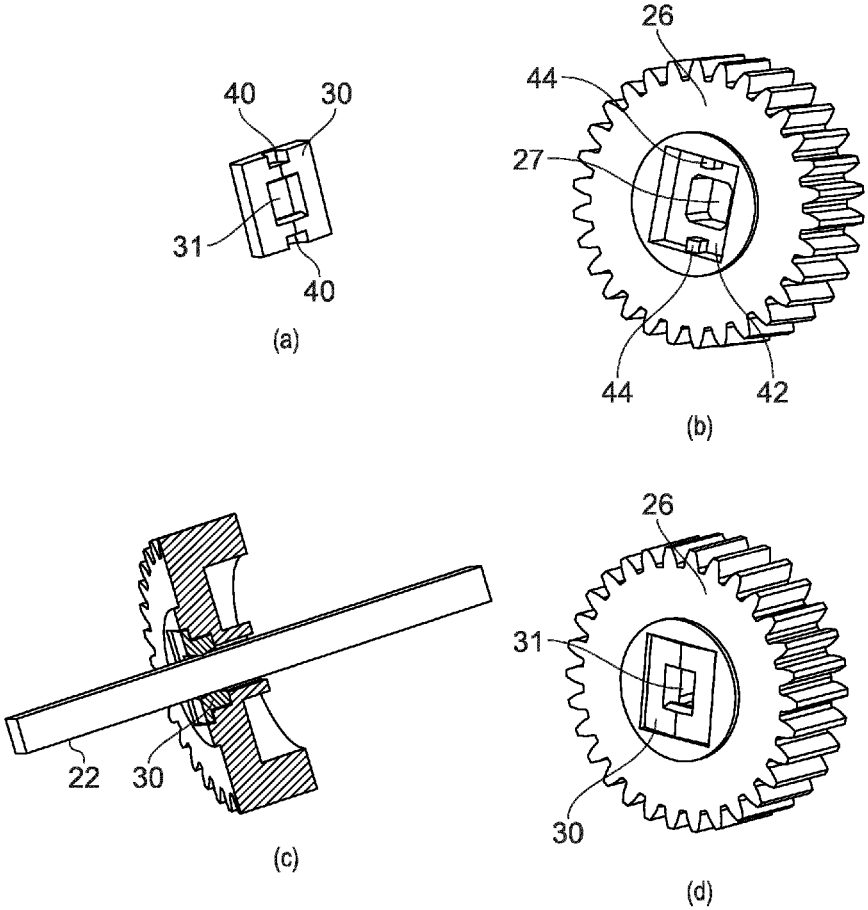
FIGS. 6 (*a*) to (*d*) illustrate an example of a rocking plate and the installation of the rocking plate in a drive wheel.

The bore 27 of the drive wheel 26 may be defined by a bore 31 in a removable rocking plate 30 as shown in FIGS. 4, 5 and 6. The rocking plate is sized so it may be inserted into a recess within the drive wheel 26. The bore 31 of the rocking plate 30 includes at least two fulcrum surfaces 32, 33. The benefit of the removable rocking plate is that the drive wheel may have an additional degree of freedom therefore the driver can accommodate further misalignments in the drive hubs 14.

The recess in the drive wheel 26 may additionally include a lug 44 which is configured to slot into a cooperating groove 40 formed in the rocking plate 30 as shown in FIGS. 5 and 6. The lug and groove thereby form a pivot for the rocking plate 30 so that the rocking plate 30 is pivotable about the drive wheel 26. The drive wheel 26 therefore experiences an additional degree of freedom about the shaft 22 further improving the ability of the drive wheel to drive with accuracy and precision, a misaligned drive hub.

In an alternative example, the rocking plate may include a lug, configured to slot into a groove within a recess in the drive wheel. The lug and groove form a pivot for the drive wheel so that the drive wheel is pivotable about the rocking plate.

The fulcrum surfaces 32, 33 of the bore 27, 31 provide some contact to the elongate shaft 22 and therefore the bore contacts the elongate shaft 22 with the fulcrum surfaces 32, 33. The bore 27, 31 contacts the shaft on at least a further two surfaces of the elongate shaft 22. Because the bore 27, 31 provides mechanical contact between the shaft 22 and the bore 27, 31, on at least four sides of the shaft 22, free play is minimised between the shaft 22 and the drive wheel 26.

One benefit of the reduction in free play between the shaft 22 and the drive wheel 26 is that the torque applied to the shaft 22 and transferred from the shaft 22 to the drive wheel 26 is better controlled, and consequently the control of torque to the drive hubs 14 of the roll module 10 and the media roll 16 is better controlled allowing more accurate control of the media roll 16.

Another benefit of the reduction in free play between the shaft 22 and the drive wheel 26 is that the torque able to be transmitted to the drive wheel 26 is higher as the contact area between the drive wheel 26 and the shaft 22 is greater. The contact pressure between the drive wheel 26 and the shaft 22 is reduced.

The cross-section of the fulcrum surfaces 32, 32 are substantially convex, triangular or dome shaped surfaces. In the examples shown in FIGS. 4, 5, and 6, the fulcrum surface is formed from two angled surfaces 32, 33 resulting in a cross-section that is substantially triangular in cross-section. The apex of the fulcrum surface contacts the shaft 22. It should be understood by the person skilled in the art that any cross-section resulting in a fulcrum surfaces is envisioned in the present disclosure.

Figure 7:
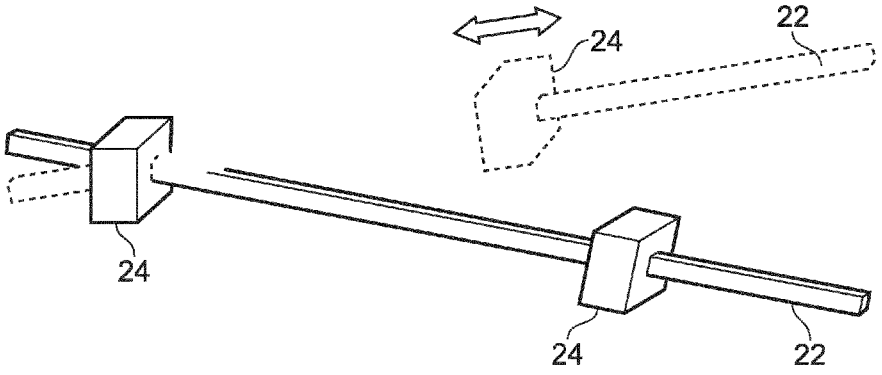
FIG. 7 illustrates an example of a drive assembly and a shaft and a degree of freedom of the drive assembly relative to the shaft.

The fulcrum surfaces 32, 33 provide an additional degree of freedom of the drive wheel relative to the shaft which allows the driver to drive the drive hub even if the drive hub is poorly aligned as shown in the sketch of FIG. 7. The drive assembly housing 24 may slide along the shaft 22 to accommodate different lengths of media rolls 16. Additionally, the drive wheel may pivot about the shaft 22 on the fulcrum surfaces 32, 33.

The bore 27, 31 may have a cross-sectional area that increases from a midpoint of the bore 27, 31 to an outside edge of the bore 27, 31.

Figure 8:
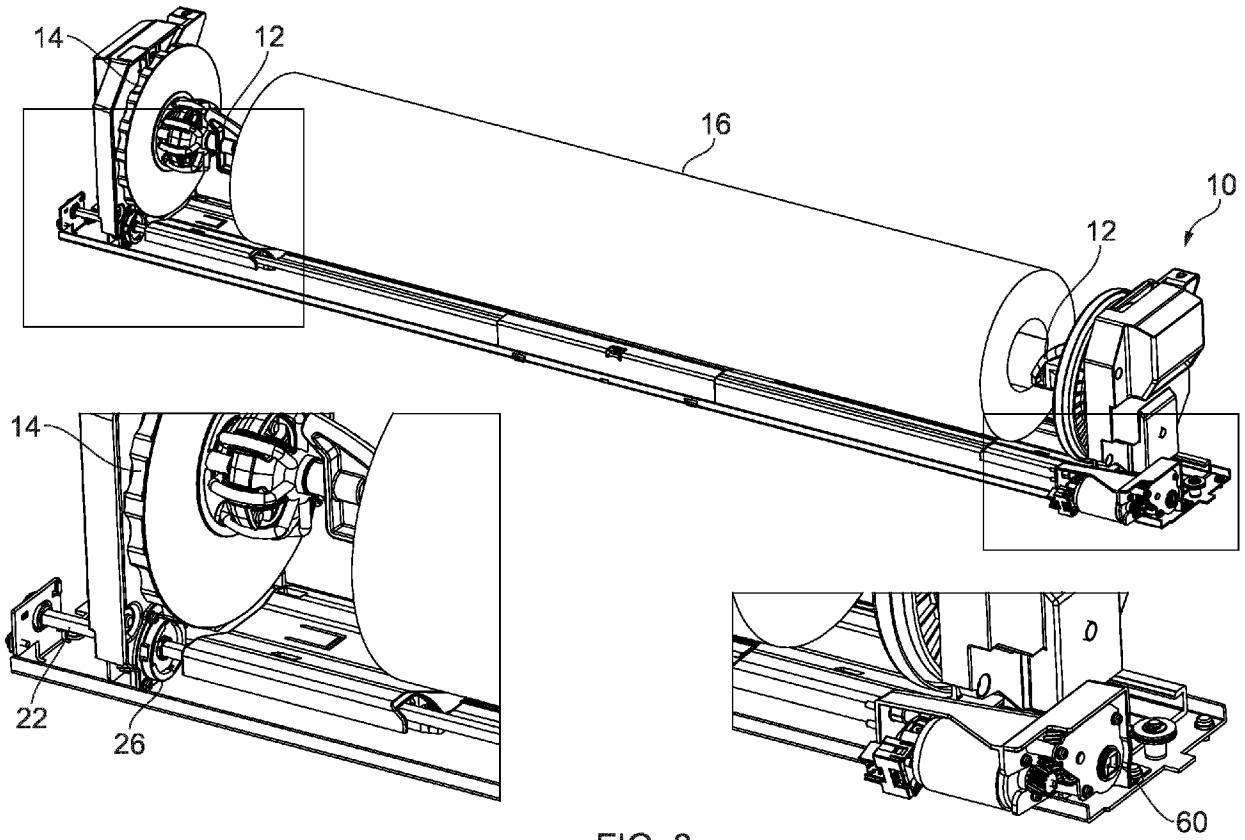
FIG. 8 illustrates an example of a driver installed in a printer, the driver aligned so that it is able to drive a drive hub of a roll module.

The driver is adapted to connect to the housing of a printer as shown in FIG. 8. The driver may connect to the static (non-moving) side of the printer via fixtures in the drive assembly housing 24. A motor 60 connects to the driver 20 and drives the driver 20. Any cabling used to connect the driver 20 to the motor 60 does not have to be routed close to the roll module 10 and thus the user is not at risk of interfering with the cables when inserting a roll module 10 into a printer. The benefit is that the motor 60 is not located on the moveable drive hub 10, and the routing of the cables is simplified.

The drive wheel 26 of the driver 20 cooperates with the drive hub 14 of the roll module 10 to control the torque applied to the roll module 10. The driver provides a simplified driver assembly construction that simplifies transferring torque between two elements without requiring the input and output shaft to be highly aligned. Furthermore, differing lengths of the input shaft and output shaft are easily accommodated by the slideable drive assemblies.

Installation of the media roll is simplified as the roll supports 12 are rotatable relative to the central axis of the roll 16, with the roll supports 12 forming drive hubs 14.

A motor located on the static side of the printer, controls the driver 20, which in turn drives the drive hubs 14 to keep the media roll under control.

The driver 20 may control the back tension applied on the media roll 16. This is critical for ensuring good control on paper skew (i.e. movement of the paper in cross web direction) as well as to ensure that the amount of advanced distance is correctly delivered to the paper.

The driver may also be operated to rewind the media when moving it backwards. When drive rollers downstream of the roll module 10 move in reverse direction, the only way to rewind the paper is by applying torque to the roll module 10 to ensure good alignment of the paper is maintained. This is because media such as paper cannot transmit compression forces.

The driver 20 may also be provided with sensors to sense the speed of the media roll 16, for example by adding a sensor (i.e. encoder) on the roll module 10 and/or the driver 20. Using sensors, the driver 20 may be controlled to identify roll speed and roll diameter to therefore estimate or detect when a media roll 16 ends. This may also feedback information to the controlling system so that the driver may apply the desired back tension to the paper.

The drive wheel 26 may be any suitable drive means such as a belt pulley, a chain sprocket, a friction wheel or a gear.

The elongate shaft 22 may have a substantially square cross-section. In another example, the elongate shaft 22 may be octagonal in cross-section.

The orifice of the drive assembly housing may be larger than the cross-section of the shaft 22 so that when the shaft 22 is inserted into the housing, the orifice does not necessarily make contact with the shaft.

The bore surrounding the shaft 22 may be loose such that the inner surface of the bore does not contact the perimeter of the shaft 22 on all sides. Such an example would provide a certain play in the drive wheel 26 relative to the shaft 22 which would accommodate misalignment of a drive hub 16. However, such an arrangement might reduce the control of torque on the drive hubs 16.

The drive hubs 14 of the roll module 10 may be integral with the roll supports 12.

The invention claimed is:

1. A driver comprising:

an elongate shaft having a polygon shaped cross-section including at least two parallel sides;

at least one drive assembly comprising:

a housing, the housing having an orifice for receiving the elongate shaft;

a drive wheel located at least partially within the housing, the drive wheel having a bore with a cross-section shaped so that the internal surface of the bore contacts the circumference of the elongate shaft, the bore having at least two fulcrum surfaces so that the drive wheel is pivotable about the elongate shaft; wherein the housing is slideable relative to the elongate shaft.

2. A driver according to claim 1, wherein the bore of the drive wheel is defined by a bore in a removable rocking plate and the rocking plate is configured for insertion into a recess within the drive wheel.

3. A driver according to claim 2, wherein the recess is provided with a lug, the lug is configured to slot into a cooperating groove formed in the rocking plate, the lug and groove forming a pivot for the rocking plate so that the rocking plate is pivotable about the drive wheel.

4. A driver according to claim 2, wherein the rocking plate is provided with a lug, the lug is configured to slot into a cooperating groove formed in the recess, the lug and groove forming a pivot for the drive wheel so that the drive wheel is pivotable about the rocking plate.

5. A driver according to claim 1, wherein the cross-sections of the fulcrum surfaces are substantially convex, triangular or dome shaped surfaces.

6. A driver according to claim 1, wherein the bore has a cross-sectional area that increases from a midpoint of the bore to an outside edge of the bore.

7. A driver according to claim 1, wherein the drive wheel is a belt pulley, a chain sprocket, a friction wheel or a gear.

8. A driver according to claim 1, wherein the elongate shaft has a substantially square cross-section.

9. A driver according to claim 1, wherein the elongate shaft has a substantially octagonal cross-section.

10. A driver according to claim 1, wherein the driver is adapted to connect to the housing of a printer.

11. A driver according to claim 1, wherein the drive wheel is adapted to drive a cooperating drive hub.

12. A driver according to claim 11, wherein the drive hub drives a media roll, the media roll being suspended between two biased supports in a roll module.

13. A method comprising:

positioning a media roll between two supports of a roll module, the roll module comprising at least one drive hub;

positioning a roll module in a printer housing, wherein positioning the roll module aligns the at least one drive hub of the roll module with at least one drive wheel of a driver as described in claim 1 so that the drive wheel cooperates with the drive hub to drive the drive hub, and driving at least one drive hub via the drive wheel to control the torque applied to the media roll.

14. A printer comprising:

a media roll module adapted to receive a spindleless media roll suspended between two supports, the supports of the media roll module being connected to drive hubs;

a driver comprising an elongate shaft having a polygon shaped cross-section including at least two parallel sides;

at least one drive assembly comprising:

a housing, the housing having an orifice for receiving the elongate shaft;

a drive wheel located at least partially within the housing, the drive wheel having a bore with a cross-section shaped so that the internal surface of the bore contacts the circumference of the elongate shaft, the bore having at least two fulcrum surfaces so that the drive wheel is pivotable about the elongate shaft; wherein the housing is slideable relative to the elongate shaft, the drive wheel cooperating with the drive hub to align the drive wheel to the drive hub to drive the media roll.

* * * * *